US006192894B1

(12) United States Patent
Yasuda

(10) Patent No.: US 6,192,894 B1
(45) Date of Patent: Feb. 27, 2001

(54) HAIR CLIP

(75) Inventor: Masahiro Yasuda, Osaka (JP)

(73) Assignee: Kabushiki Kaisha Yasuda Corporation, Osaka (JP)

( * ) Notice: Subject to any disclaimer, the term of this patent is extended or adjusted under 35 U.S.C. 154(b) by 0 days.

(21) Appl. No.: 09/450,505

(22) Filed: Nov. 30, 1999

(30) Foreign Application Priority Data

May 26, 1999 (JP) ..... 11-146599

(51) Int. Cl.[7] ..... A45D 8/20
(52) U.S. Cl. ..... 132/277; 132/276; 132/279
(58) Field of Search ..... 132/275, 276, 132/277, 278, 279, 280; D28/39, 40, 41, 42; 24/507, 521, 510, 509, 511, 556

(56) References Cited

U.S. PATENT DOCUMENTS

D. 429,030 * 8/2000 Yasuda ..... D28/40
2,205,442 * 6/1940 Solomon ..... 132/277
3,242,564 * 3/1966 Longhini ..... 132/277
5,881,741 * 3/1999 Chen ..... 132/277
6,019,108 * 2/2000 Chen ..... 132/276

* cited by examiner

*Primary Examiner*—Philogene Pedro
(74) *Attorney, Agent, or Firm*—Armstrong, Westerman, Hattori, McLeland & Naughton

(57) ABSTRACT

A hair clip includes a pair of hair retainers for retaining hair therebetween and a pivotal shaft for pivoting the hair retainers. Each hair retainer has a pair of opposing hinge ledges at one end portion thereof. The hinge ledges of one of the hair retainers are disposed adjacent to those of the other hair retainer. A pivotal shaft is inserted into shaft penetrating apertures formed in the hinge ledges so that the hair retainers are pivoted about the pivotal shaft. One of adjacent hinge ledges is provided with a hinge cover for covering an inside edge of the other adjacent hinge ledge along an inside edge of one of adjacent hinge ledges, whereby hair is prevented from being introduced into a gap between adjacent hinge ledges, and/or one of adjacent hinge ledges disposed outside is provided with an outwardly protruded cylindrical portion in which an enlarged head portion of the pivotal shaft is disposed, whereby hair is prevented from being introduced into a gap between the enlarged head portion and one of adjacent hinge ledges disposed outside.

17 Claims, 4 Drawing Sheets

HAIR CLIP

BACKGROUND OF THE INVENTION

1. Field of the Invention

This invention relates to a hair clip for retaining hairs between a pair of hair retainers pivoted by hinge portions.

2. Description of the Related Art

FIGS. 5 and 6 illustrate a hair clip B as a related art. The hair clip B includes a pair of hair retainers 51, 52 each having a lever portions 51*b*, 52*b* at one end thereof. These hair retainers 51, 52 are pivoted at one end portions and urged by a coil spring 56 so as to close the other end 51*a*, 52*a* of the hair retainers 51, 52.

Each hair retainer 51(52) is provided with a pair of opposing hinge ledges 53, 53(54, 54) at both lateral sides near the lever portion 51*b*(52*b* ). The pair of hinge ledges 53, 53 of one of the hair retainers 51 are disposed outside the pair of hinge ledges 54, 54 of the other of hair retainers 52. These hinge ledges 53, 53, 54, 54 are pivoted by a pivotal shaft 55(i.e., a rivet) on which a coil spring 56 is wounded. Thus, the pair of hair retainers 51, 52 are allowed to rotate, i.e., open and close, about the pivotal shaft 55 with the other end 51*a*, 52*a* of the hair retainers 51, 52 urged in a closing direction.

Therefore, in a state that the hair clip is not in use, the hair retainers 51, 52 are closed due to the spring force of the coil spring 56. By gripping the lever portions 51*b*, 52*b*, the hair retainers 51, 52 are opened so that hairs can be retained between the hair retainers 51, 52.

In the meantime, the corresponding hinge ledges 53, 54 of the hair retainers 51, 52 are disposed close to each other. However, a gap is usually formed between the adjacent hinge ledges 53, 54 so that the hair retainers 51, 52 can be freely opened and closed. As a result, there is the fear of unintentionally introducing hair into the gap, i.e., between the adjacent hinge ledges 53, 54.

Also, a gap is formed between the head portion 55*a*, 55*b* of the pivotal shaft 55 and the hinge ledge 53, 53 located outside. Accordingly, hair may also be introduced unintentionally into the gap, i.e., between the head portion 55*a*, 55*b* and the hinge ledges 53, 53. In cases where the user's hairs are introduced into these gaps and caught therein, a few hairs may be pulled out of the user's head. This not only gives the pain to the user but also makes the user uncomfortable because of losing hair.

SUMMARY OF THE INVENTION

It is an object of the present invention to provide a hair clip which has no fear of introducing hair into a gap between adjacent hinge ledges of a pair of hair retainers.

It is another object of the present invention to proved a hair clip which has no fear of introducing hair into a gap between an enlarged head portion of a pivotal shaft and an outside hinge ledge.

According to a first aspect of the present invention, a hair clip includes:

a pair of hair retainers for retaining hair therebetween, each of the hair retainers having a first end portion and a second end portion;

a pivotal shaft for pivoting the pair of hair retainers at the first end portions; and a spring for urging the second end portions of the pair of hair retainers in a closing direction thereof, wherein each of the hair retainers includes a pair of opposing hinge ledges provided at the first end portion, the pair of opposing hinge ledges of one of the hair retainers being disposed adjacent to corresponding the pair of opposing hinge ledges of the other of the hair retainers, wherein the pivotal shaft is inserted into shaft receiving apertures formed in the hinge ledges so that the pair of hair retainers are pivoted about the pivotal shaft, and wherein one of the adjacent hinge ledges is provided with a hinge cover for covering an inside edge of the other of the adjacent hinge ledges along an inside edge of one of the adjacent hinge ledges, whereby hair is prevented from being introduced into a gap between the adjacent hinge ledges.

With this hair clip according to the first aspect of the present invention, since hair is prevented from being introduced into the gap between the adjacent hinge ledges, it is prevented that hair is caught by the adjacent hinge ledges and pulled out of a user's head when detaching the hair clip from the user's head. Thus, the hair clip does not make the user uncomfortable. Furthermore, since the hinge cover is provided along the inside edge of one of adjacent hinge ledges, the hinge ledges are strengthened, resulting in enhanced durability.

According to a second aspect of the present invention, a hair clip includes a pair of hair retainers for retaining hair therebetween, each of the hair retainers having a first end portion and a second end portion;

a pivotal shaft for pivoting the pair of hair retainers at the first end portions; and a spring for urging the second end portions of the pair of hair retainers in a closing direction thereof, wherein each of the hair retainers includes a pair of opposing hinge ledges provided at the first end portion, the pair of opposing hinge ledges of one of the hair retainers being disposed adjacent to corresponding pair of opposing hinge ledges of the other of the hair retainers, wherein the pivotal shaft is inserted into shaft receiving apertures formed in the hinge ledges so that the pair of hair retainers are pivoted about the pivotal shaft, wherein one of the adjacent hinge ledges disposed outside is provided with an outwardly protruded cylindrical portion, and wherein an enlarged head portion of the pivotal shaft is disposed in the cylindrical portion, whereby hair is prevented from being introduced into a gap between the enlarged head portion and the one of the adjacent ledges disposed outside.

With this hair clip according to the second aspect of the present invention, since hair is prevented from being introduced into a gap between the enlarged head portion of the pivotal shaft and the outside hinge ledge, it is prevented that hair is caught by the enlarged head portion and the outside hinge ledge when detaching the hair clip from the user's head. Thus, the hair clip does not make the user uncomfortable. Furthermore, since the hinge cover is provided along the inside edge of one of adjacent hinge ledges, the hinge ledges are strengthened, resulting in enhanced durability.

According to a third aspect of the present invention, a hair clip includes:

a pair of hair retainers for retaining hair therebetween, each of the hair retainers having a first end portion and a second end portion and having a lever portion at the first end portion;

a pivotal shaft for pivoting the pair of hair retainers at the first end portions; and a coil spring wounded around the pivotal shaft for urging the second end portions of the pair of hair retainers in a closing direction thereof, wherein each of the hair retainers includes a pair of opposing hinge ledges extending from lateral edges of the first end portion, the pair of opposing hinge ledges of one of the hair retainers being disposed adjacent to corresponding pair of opposing hinge ledges of the other of the hair retainers, wherein the pivotal shaft is inserted into shaft receiving apertures formed in the hinge ledges so that the pair of hair retainers are pivoted about the pivotal shaft, wherein one of the adjacent hinge ledges is provided with a hinge cover for covering an inside edge of the other of the adjacent hinge ledges along an inside edge of the one of the adjacent hinge ledges, whereby hair is prevented from being introduced into a gap between the adjacent hinge ledges, wherein one of the adjacent hinge ledges disposed outside is provided with an outwardly protruded cylindrical portion, and wherein an enlarged head portion of the pivotal shaft is disposed in the cylindrical portion, whereby hair is prevented from being introduced into a gap between the enlarged head portion and the one of the adjacent ledged disposed outside.

BRIEF EXPLANATION OF THE DRAWINGS

Other objects and advantages of the present invention will become apparent from the detailed description of the preferred embodiments with reference to the attached drawings, wherein.

DETAILED DESCRIPTION OF THE PREFERRED EMBODIMENTS

Preferred embodiments of a hair clip, according to the present invention, will now be described in detailed, with reference to the accompanying drawings.

Figure 3:
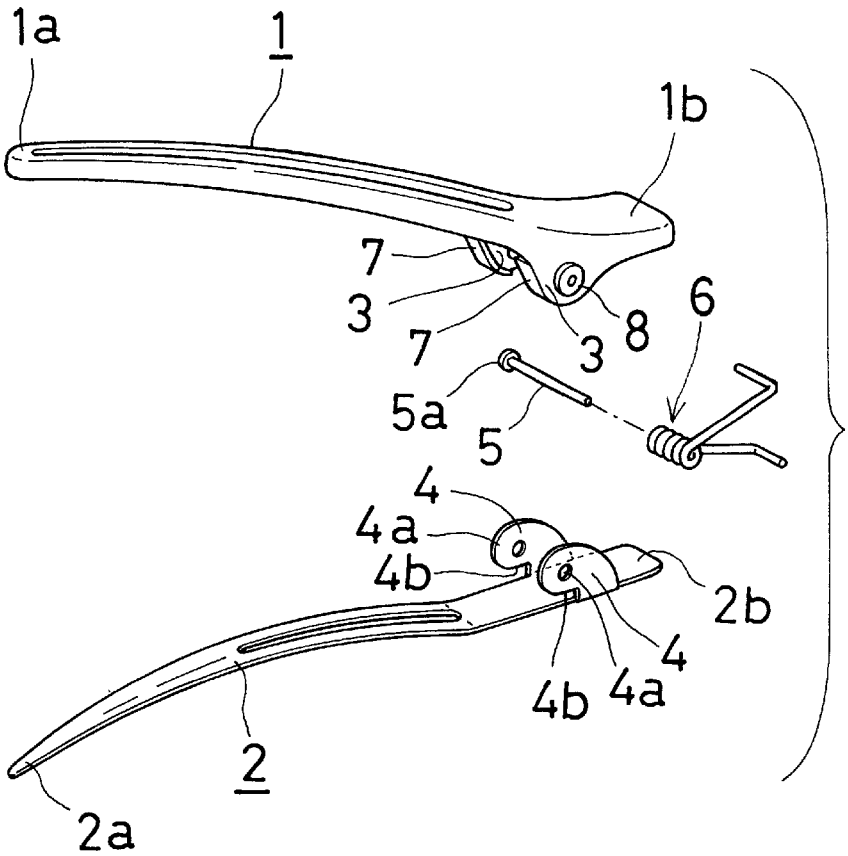
FIG. 3 shows an exploded perspective view of the hair clip shown in FIG. 1.

As shown in FIG. 3, the hair clip includes a pair of hair retainer 1, 2, a pivotal shaft 5 and a coil spring 6.

Each hair retainer 1, 2 is an elongated narrow plate-like member having a lever portion 1*b*, 2*b* at its longitudinal one end portion. One of the pair of hair retainers 1, which is disposed outside when the hair clip is attached to the user's head (hereinafter referred to as "outside hair retainer"), is a semirigid plastic molded article. However, the materials of the hair retainer 1 is not limited to the above, and may be made of various materials.

The outside hair retainer 1 is provided with a pair of opposing hinge ledges 3, 3 downwardly extending from both lateral side edges of the longitudinal one end portion of the hair retainer 1. Each of the pair of hinge ledges 3, 3 has a shaft penetrating aperture 3*a*, 3*a* (see FIG. 2B).

On the other hand, the other hair retainer 2, which is disposed inside when the hair clip is attached to the user's head (hereinafter referred to as "inside hair retainer"), is an elongated plate-like metal member. The plate-like member is preferably made of an aluminum alloy which has enhanced corrosion resistance and is light in weight. However, the materials of the hair retainer 2 is not limited to the above, and may be made of various materials including a synthetic resin. The inside hair retainer 2 is provided with a pair of opposing hinge ledges 4, 4 upwardly extending from both lateral side edges of one end portion of the hair retainer 2. Each of the pair of hinge ledges 4, 4 has a shaft penetrating aperture 4*a*, 4*a* (see FIG. 3).

Figure 1:
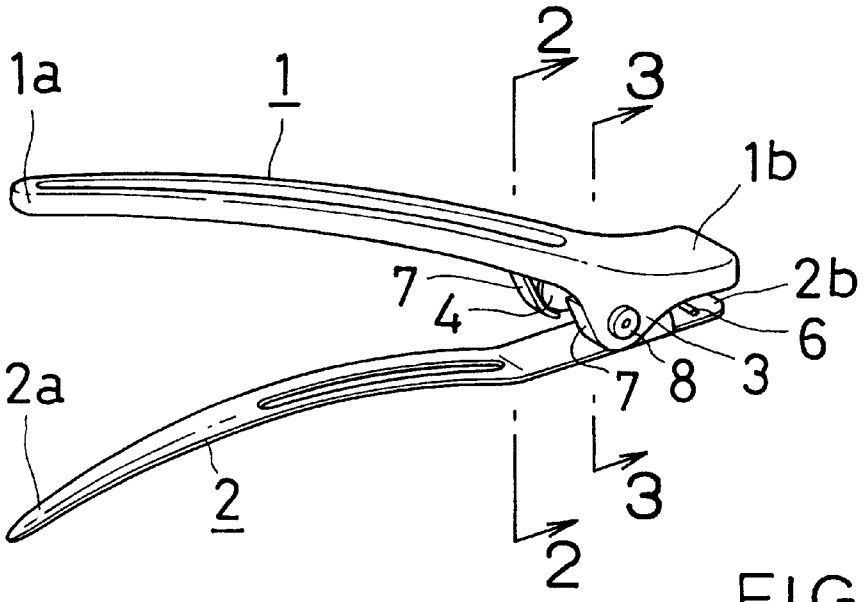
FIG. 1 shows a perspective view of a hair clip of an embodiment according to the present invention.
Figure 2A:
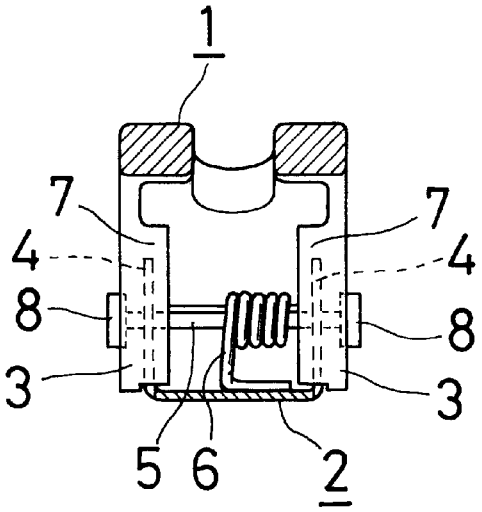
FIG. 2A shows a cross-sectional view taken along the line 2—2 in FIG. 1.
Figure 2B:
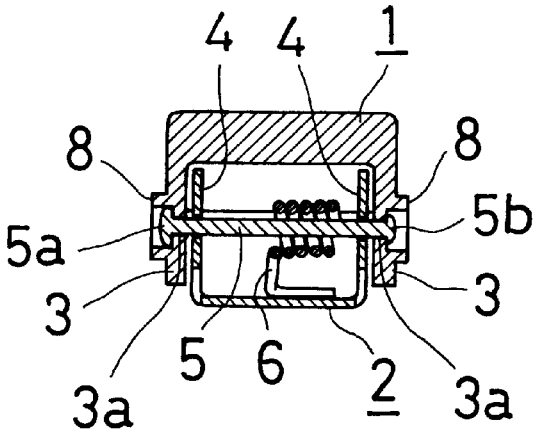
FIG. 2B shows a cross-sectional view taken along the line 3—3 in FIG. 1.

As shown in FIG. 2B, the hinge ledges 3, 3 of the outside hair retainer 1 are disposed adjacent to and outside the hinge ledges 4, 4 of the inside hair retainer 2. The end portions of the pivotal shaft 5 are fitted in the corresponding shaft penetrating apertures 3*a*, 4*a*, whereby the hair retainers 1, 2 are pivoted, i.e., opened and closed, about the pivotal shaft 5.

As shown in FIG. 2A and 2B, the coil spring 6 is wounded around the pivotal shaft 5. The extended end portions of the coil spring 6 are fitted on the opposing surfaces of the lever portions 1*b*, 2*b* of the hair retainers 1, 2. The coil spring 6 urges the hair retainers 1, 2 in a closing direction. The coil spring 6 may be substituted by any other member for urging the hair retainers 1, 2 in a closing direction.

The corresponding hinge ledges 3, 4 of the pair of hair retainers 1, 2 are disposed side by side and fitted each other. However, in actual, the adjacent hinge ledges 3, 4 are not tightly fitted each other so that the hair retainers 1, 2 can be rotated without causing friction. Thus, a gap is usually formed therebetween. Therefore, in an actual use of the hair clip, there may be a possibility that hair is introduced into the gap and caught therein. In a state that hair is caught by the adjacent hinge ledges 3, 4, when the hair clip is detached from the user's head, the hair may be pulled out of the user's head. Therefore, in this embodiment, in order to prevent hair from being introduced into the gap, a hinge cover 7 is integrally inwardly extended along an inside edge of the hinge ledge 3 facing the other end 1*a* of the outside hair retainer 1 (hereinafter simply referred to as "inside edge of the hinge ledge 3"). Thus, this hinge cover 7 covers an inside edge of the hinge ledge 4 facing the other end 2*b* of the inside hair retainer 2 (hereinafter simply referred to as "inside edge of the hinge ledge 4").

As is apparent from the above, by providing the aforementioned hinge cover 7, hair is prevented from being introduced into the gap between the adjacent hinge ledges 3, 4.

In this embodiment, the hinge covers 7 are provided at both the hinge ledges 3, 3 of the outside hair retainer 1. However, the present invention is not limited to the above. For example, outwardly extended hinge covers may be provided along the inside edges of the hinge ledges 4, 4 of the inside hair retainer 2 so as to cover the hinge ledges 3, 3 of the outside hair retainer 1. Furthermore, in this embodiment, although the hinge ledges 3, 3 of the outside hair retainer 1 are disposed outside the hinge ledges 4, 4 of the inside hair retainer 2, the hinge ledges 4, 4 of the inside hair retainer 1 may be disposed outside the hinge ledges 3, 3 of the outside hair retainer 1.

Furthermore, in this embodiment, in order to prevent hair from being introduced into the gap between adjacent hinge ledges 3, 4 regardless of an opening angle of the pair of hair retainers 1, 2, the following structure is employed.

Figure 4A:
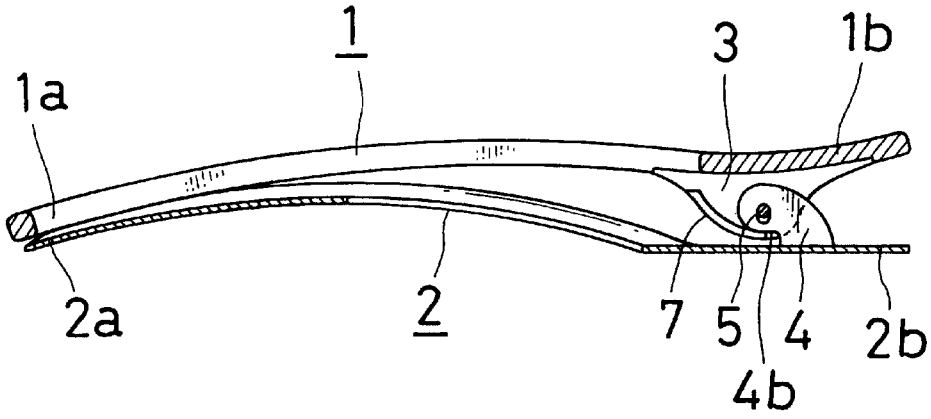
FIG. 4A shows a side cross-sectional view of the hair clip shown in FIG. 1 in a closed state.
Figure 4B:
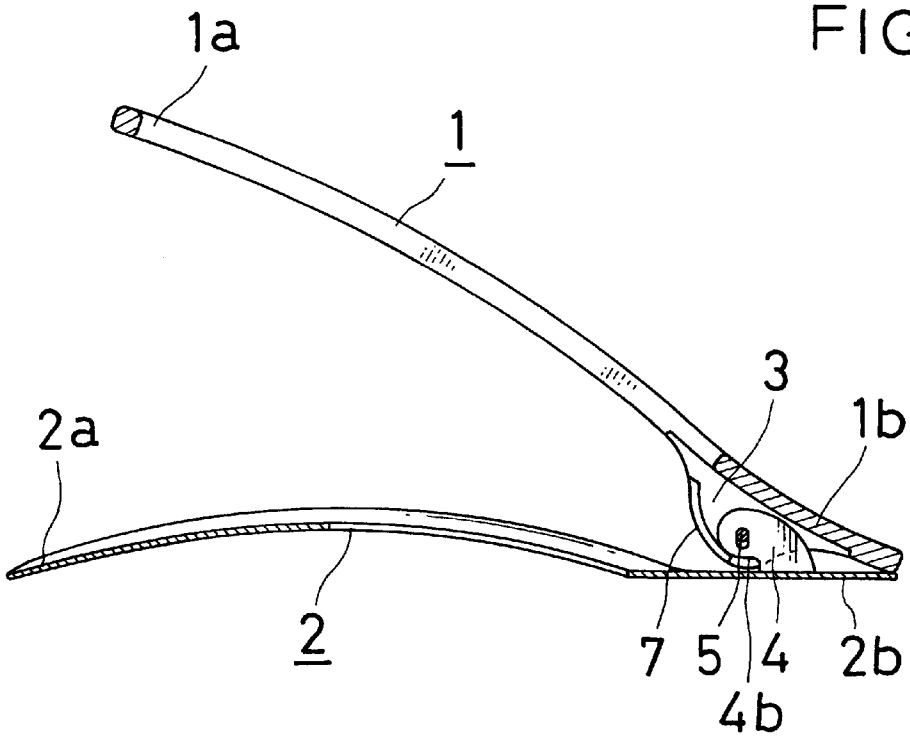
FIG. 4B shows a side cross-sectional view of the hair clip shown in FIG. 1 in an opened state.
Figure 5:
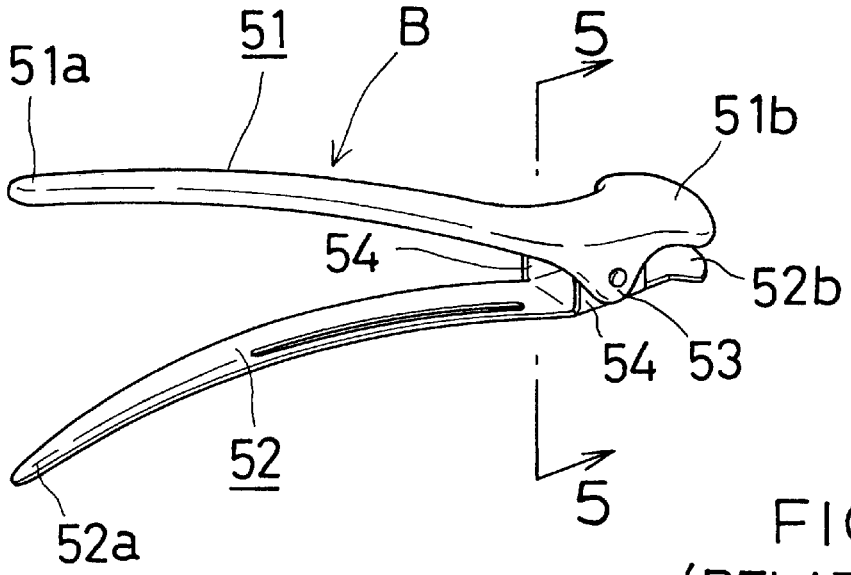
FIG. 5 (RELATED ART)
FIG. 5 shows a perspective view of a hair clip as a related art.
Figure 6:
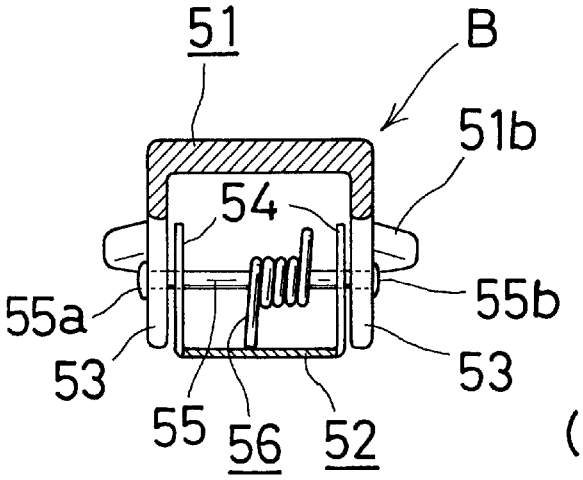
FIG. 6 (RELATED ART)
FIG. 6 shows a cross-sectional view taken along the line 5—5 in FIG. 5.

As shown in FIG. 3, a slot 4*b* is formed at an basal end portion of each hinge ledge 4 of the inside hair retainer 2. This slot 4*b* extends from the inside edge of the basal end portion to a lower portion of the shaft penetrating aperture 4*a* . Thus, as shown in FIG. 4A, in a state that the pair of hair retainers 1, 2 are closed, the hinge cover 7 is introduced into the slot 4*b*. On the other hand, as shown in FIG. 4B, in a state that the pair of hair retainers 1, 2 are opened, the hinge cover 7 still covers the inside edge of the hinge ledge 4 of the inside hair retainer 2. Accordingly, since the inside edge of the hinge ledge 4 of the inside hair retainer 2 is always covered by the hinge cover 7 regardless of the opening angle of the pair of hair retainers 1, 2, hair is surely prevented from being introduced into the gap between the adjacent hinge ledges 3, 4.

In the meantime, as shown in FIG. 3, the pivotal shaft 5 has originally an enlarged head portion 5*a* at its one end so that the shaft 5 can be inserted into the shaft penetrating apertures 3*a*, 4*a* of the hinge ledges 3, 4 from one side thereof. After the insertion of the pivotal shaft 5 into the shaft penetrating apertures 3*a*, 4*a*, the other end of the pivotal shaft 5 is deformed to have an enlarged head 5*b* (see FIG. 2B) so as not to be pulled out therefrom. Thus, the pivotal shaft 5 has enlarged head portions 5*a*, 5*b* at both ends. However, there may be a gap between the enlarged head portion 5*a*, 5*b* and the outer surface of the outside hinge ledge 3. Thus, in an actual use of the hair clip, there may be a possibility that hair is caught by and between the enlarged head portion 5*a*, 5*b* and the outside hinge ledge 3. In a state that hair is caught by and between the enlarged head portion 5*a*, 5*b* and the outside hinge ledges 3, 3, when the hair clip is detached from the user's head, the hair may be pulled out of the user's head. In this embodiment, in order to prevent hair from being introduced into the gap, a cylindrical portion 8 for covering the enlarged head portion 5*a*, 5*b* is integrally formed on an outside surface of each of the hinge ledges 3, 3 of the outside hair retainer 1. Thus, hair is prevented from inserted into the gap between the enlarged head portion 5*a*, 5*b* and the outside hinge ledges 3, 3 because the enlarged head portion 5*a*, 5*b* is covered by the cylindrical portion. 8

According to the first aspect of the present invention, the hair clip includes a pair of hair retainers for retaining hair therebetween, each of the hair retainers having a first end portion and a second end portion, a pivotal shaft for pivoting the pair of hair retainers at the first end portions, and a spring for urging the second end portions of the pair of hair retainers in a closing direction thereof, wherein each of the hair retainers includes a pair of opposing hinge ledges provided at the first end portion, the pair of opposing hinge ledges of one of the hair retainers being disposed adjacent to corresponding pair of opposing hinge ledges of the other of the hair retainers, wherein the pivotal shaft is inserted into shaft receiving apertures formed in the hinge ledges so that the pair of hair retainers are pivoted about the pivotal shaft, and wherein one of the adjacent hinge ledges is provided with a hinge cover for covering an inside edge of the other of the adjacent hinge ledges along an inside edge of one of the adjacent hinge ledges, whereby hair is prevented from being introduced into a gap between the adjacent hinge ledges.

With this hair clip, since hair is prevented from being introduced into the gap between the adjacent hinge ledges, it is prevented that hair is caught by and between the adjacent hinge ledges and is pulled out of a user's head when detaching the hair clip from a user's head. Thus, the hair clip does not make the user uncomfortable. Furthermore, since the hinge cover is provided along the inside edge of one of adjacent hinge ledges, the hinge ledges are strengthened, resulting in enhanced durability.

It is preferable that the hinge cover has a width and a length each sufficient to prevent hair from being introduced into the gap regardless of an opening angle of the pair of hair retainers.

It is also preferable that the hinge cover extends inwardly from an inside edge of one of the adjacent hinge ledges disposed outside.

Furthermore, it is preferable that one of the adjacent hinge ledges has a slot at a basal end portion thereof, the slot extending from the inside edge, and wherein the hinge cover is introduced into the slot when the pair of hair retainers are closed.

It is preferable that the pair of hinge ledges extend from both lateral edges of the first end portion of each of the hair retainers.

The spring may be a coil spring wounded around the pivotal shaft.

It is preferable that each of the hair retainers has a lever portion at the first end portion.

It is preferable that one of the hair retainers disposed outside when the hair clip is attached to a user's head is a synthetic resign molded article, and wherein the hinge ledges of the one of the hair retainers disposed outside are located outside the hinge ledges of the other of the hair retainers. This enables an easy forming of any shapes and/or any colors of the hair retainer.

According to the second aspect of the present invention, hair retainer includes a pair of hair retainers for retaining hair therebetween, each of the hair retainers having a first end portion and a second end portion;

a pivotal shaft for pivoting the pair of hair retainers at the first end portions; and a spring for urging the second end portions of the pair of hair retainers in a closing direction thereof, wherein each of the hair retainers includes a pair of opposing hinge ledges provided at the first end portion, the pair of opposing hinge ledges of one of the hair retainers being disposed adjacent to corresponding pair of opposing hinge ledges of the other of the hair retainers, wherein the pivotal shaft is inserted into shaft receiving apertures formed in the hinge ledges so that the pair of hair retainers are pivoted about the pivotal shaft, wherein one of the adjacent hinge ledges disposed outside is provided with an outwardly protruded cylindrical portion, and wherein an enlarged head portion of the pivotal shaft is disposed in the cylindrical portion, whereby hair is prevented from being introduced into a gap between the enlarged head portion and the one of the adjacent ledges disposed outside.

With this hair clip according to the second aspect of the present invention, since hair is prevented from being introduced into gaps between the enlarged head portion of the pivotal shaft and the outside hinge ledge, it is prevented that hair is caught by and between the enlarged head portion and the outside hinge ledge and is pulled out of a user's head. This makes the user comfortable even when detaching the hair clip from the user's head. Furthermore, since the outside hinge ledge is provided with an outwardly protruded cylindrical portion, the hinge ledges are strengthened, resulting in enhanced durability.

It is preferable that the spring is a coil spring wounded around the pivotal shaft.

It is preferable that each of the hair retainers has a lever portion at the first end portion.

It is preferable that one of the hair retainers disposed outside when the hair clip is attached to a user's head is a synthetic molded article, and wherein the hinge ledges of the one of the hair retainers disposed outside are disposed outside the hinge ledges of the other of the hair retainers. This enables an easy forming of any shapes and/or any colors of the hair retainer.

In the aforementioned embodiment, although each hair retainer is an elongated plate-shaped member, the present invention is not limited to it. The hair retainer may be of any shape so long as a pair of hair retainers are pivoted by hinge ledges.

The present invention claims a priority based on the Japanese Patent Application No. H11-146599 filed on May 26, 1999, the contents of which is incorporated hereinto by reference in its entirety.

The terms and expressions which have been employed herein are used as terms of description and not of limitation, and there is no intent, in the use of such terms and expressions, of excluding any equivalents of the features shown and described or portions thereof, but it should be recognized that various modifications are possible within the scope of the invention claimed.

What is claimed is:

1. A Hair clip, comprising:

a pair of hair retainers for retaining hair therebetween, each of said hair retainers having a first end portion and a second end portion;

a pivotal shaft for pivoting said pair of hair retainers at said first end portions; and a spring for urging said second end portions of said pair of hair retainers in a closing direction thereof, wherein each of said hair retainers includes a pair of opposing hinge ledges provided at said first end portion, said pair of opposing hinge ledges of one of said hair retainers being disposed adjacent to corresponding said pair of opposing hinge ledges of the other of said hair retainers, wherein said pivotal shaft is inserted into shaft receiving apertures formed in said hinge ledges so that said pair of hair retainers are pivoted about said pivotal shaft, and wherein one of said adjacent hinge ledges is provided with a hinge cover for covering an inside edge of the other of said adjacent hinge ledges along an inside edge of one of said adjacent hinge ledges, whereby hair is prevented from being introduced into a gap between said adjacent hinge ledges.

2. The hair clip as recited in claim 1, wherein said hinge cover has a width and a length each sufficient to prevent hair from being introduced into said gap regardless of an opening angle of said pair of hair retainers.

3. The hair clip as recited in claim 1, wherein said hinge cover extends inwardly from an inside edge of one of said adjacent hinge ledges disposed outside.

4. The hair clip as recited in claim 1, wherein one of said adjacent hinge ledges has a slot at a basal end portion thereof, said slot extending from said inside edge, and wherein said hinge cover is introduced into said slot when said pair of hair retainers are closed.

5. The hair clip as recited in claim 1, wherein said pair of hinge ledges extend from both lateral edges of said first end portion of each of said hair retainers.

6. The hair clip as recited in claim 1, wherein said spring is a coil spring wounded around said pivotal shaft.

7. The hair clip as recited in claim 1, wherein each of said hair retainers has a lever portion at said first end portion.

8. The hair clip as recited in claim 1, wherein one of said hair retainers disposed outside when the hair clip is attached to a user's head is a synthetic molded article, and wherein said hinge ledges of said one of said hair retainers disposed outside are located outside said hinge ledges of the other of said hair retainers.

9. A hair clip, comprising:

a pair of hair retainers for retaining hair therebetween, each of said hair retainers having a first end portion and a second end portion;

a pivotal shaft for pivoting said pair of hair retainers at said first end portions; and a spring for urging said second end portions of said pair of hair retainers in a closing direction thereof, wherein each of said hair retainers includes a pair of opposing hinge ledges provided at said first end portion, said pair of opposing hinge ledges of one of said hair retainers being disposed adjacent to corresponding said pair of opposing hinge ledges of the other of said hair retainers, wherein said pivotal shaft is inserted into shaft receiving apertures formed in said hinge ledges so that said pair of hair retainers are pivoted about said pivotal shaft, wherein one of said adjacent hinge ledges disposed outside is provided with an outwardly protruded cylindrical portion, and wherein an enlarged head portion of said pivotal shaft is disposed in said cylindrical portion, whereby hair is prevented from being introduced into a gap between said enlarged head portion and said one of said adjacent ledges disposed outside.

10. The hair clip as recited in claim 9, wherein said spring is a coil spring wounded around said pivotal shaft.

11. The hair clip as recited in claim 9, wherein each of said hair retainers has a lever portion at said first end portion.

12. The hair clip as recited in claim 9, wherein one of said hair retainers disposed outside when the hair clip is attached to a user's head is a synthetic molded article, and wherein said hinge ledges of said one of said hair retainers disposed outside are disposed outside said hinge ledges of the other of said hair retainers.

13. A hair clip, comprising:

a pair of hair retainers for retaining hair therebetween, each of said hair retainers having a first end portion and a second end portion and having a lever portion at said first end portion;

a pivotal shaft for pivoting said pair of hair retainers at said first end portions; and a coil spring wounded around said pivotal shaft for urging said second end portions of said pair of hair retainers in a closing direction thereof, wherein each of said hair retainers includes a pair of opposing hinge ledges extending from lateral edges of said first end portion, said pair of opposing hinge ledges of one of said hair retainers being disposed adjacent to corresponding said pair of opposing hinge ledges of the other of said hair retainers, wherein said pivotal shaft is inserted into shaft receiving apertures formed in said hinge ledges so that said pair of hair retainers are pivoted about said pivotal shaft, wherein one of said adjacent hinge ledges is provided with a hinge cover for covering an inside edge of the other of said adjacent hinge ledges along an inside edge of said one of said adjacent hinge ledges, whereby hair is prevented from being introduced into a gap between said adjacent hinge ledges, wherein one of said adjacent hinge ledges disposed outside is provided with an outwardly protruded cylindrical portion, and wherein an enlarged head portion of said pivotal shaft is disposed in said cylindrical portion, whereby hair is prevented from being introduced into a gap between said enlarged head portion and said one of said adjacent ledged disposed outside.

14. The hair clip as recited in claim 13, wherein said hinge cover has a width and a length each sufficient to prevent hair from being introduced into said gap regardless of an opening angle of said pair of hair retainers.

15. The hair clip as recited in claim 13, wherein said hinge cover inwardly extends from an inside edge of one of said adjacent hinge ledges disposed outside.

16. The hair clip as recited in claim 13, wherein one of said adjacent hinge ledges has a slot at a basal end thereof, said slot extending from said inside edge, and wherein said hinge cover provided to the other of said adjacent hinge ledges is introduced into said slot when said pair of hair retainers are closed.

17. The hair clip as recited in claim 13, wherein one of said hair retainers disposed outside the hair clip is attached to a user's head is a synthetic molded article, and wherein hinge ledges of said one of said hair retainers are disposed outside said hinge ledges of the other of said hair retainers.

* * * * *